US010449109B1

(12) United States Patent
Barnett

(10) Patent No.: US 10,449,109 B1
(45) Date of Patent: Oct. 22, 2019

(54) ADJUSTABLE KNOBER SYSTEM AND METHOD OF USE

(71) Applicant: Donald E. Barnett, White Settlement, TX (US)

(72) Inventor: Donald E. Barnett, White Settlement, TX (US)

( * ) Notice: Subject to any disclaimer, the term of this patent is extended or adjusted under 35 U.S.C. 154(b) by 432 days.

(21) Appl. No.: 15/236,159

(22) Filed: Aug. 12, 2016

Related U.S. Application Data

(60) Provisional application No. 62/283,190, filed on Aug. 24, 2015.

(51) Int. Cl.
*A61H 7/00* (2006.01)
*A61H 39/04* (2006.01)

(52) U.S. Cl.
CPC ..... *A61H 7/002* (2013.01); *A61H 7/007* (2013.01); *A61H 39/04* (2013.01); *A61H 2201/0123* (2013.01); *A61H 2201/1623* (2013.01); *A61H 2205/081* (2013.01)

(58) Field of Classification Search
CPC ..... A61H 7/002; A61H 2205/081; A61H 1/0292; A61H 39/04; A61H 2201/00119; A61H 2201/0123; A61H 2201/0157; A61H 2201/0176; A61H 2201/1253; A61H 2201/1284; A61H 2201/1623; A61H 2201/1626; A61H 2201/1695
See application file for complete search history.

(56) References Cited

U.S. PATENT DOCUMENTS

| | | | | |
|---|---|---|---|---|
| 5,913,839 | A * | 6/1999 | Wincek | A61H 7/001 601/115 |
| 7,087,004 | B1 * | 8/2006 | Berke | A61H 7/002 482/132 |
| 7,320,668 | B1 * | 1/2008 | Warder | A61H 7/001 601/136 |
| 2004/0092850 | A1 * | 5/2004 | Fors | A61H 7/00 601/134 |
| 2008/0086066 | A1 * | 4/2008 | Munday | A61H 39/04 601/135 |
| 2008/0139981 | A1 * | 6/2008 | Walquist | A61H 7/001 601/134 |
| 2015/0011921 | A1 * | 1/2015 | Sidhu | A61H 7/001 601/134 |
| 2016/0317386 | A1 * | 11/2016 | Suttman | A61H 7/001 |
| 2016/0338901 | A1 * | 11/2016 | Cohen | A61H 15/00 |

* cited by examiner

*Primary Examiner* — Quang D Thanh
(74) *Attorney, Agent, or Firm* — Eldredge Law Firm, LLC; Richard Eldredge; Beth Felix

(57) ABSTRACT

An adjustable knober system includes an elongated structure; a knober adjustably engaged with the elongated structure; an adjuster secured to the knober and configured to adjust a position of the knober relative to the elongated structure; and a mount secured to a back surface of the elongated structure, the mount is configured to secure the elongated structure of a support structure.

6 Claims, 2 Drawing Sheets

ADJUSTABLE KNOBER SYSTEM AND METHOD OF USE

BACKGROUND

1. Field of the Invention

The present invention relates generally to systems and methods for working out spasms and tight muscles in the back.

2. Description of Related Art

Conventional methods to work out spasms and tight muscles typically include a visit to a doctor's Office, a massage therapist, home fixtures, and the like. A common problem associated with one or more of these types of fixes include the costs and time associated with visiting the doctor and/or therapist of the ineffective means of home fixtures in resolving the issue.

Accordingly, the is a need for a cheap and effective means to work out spasms and tight back muscles.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
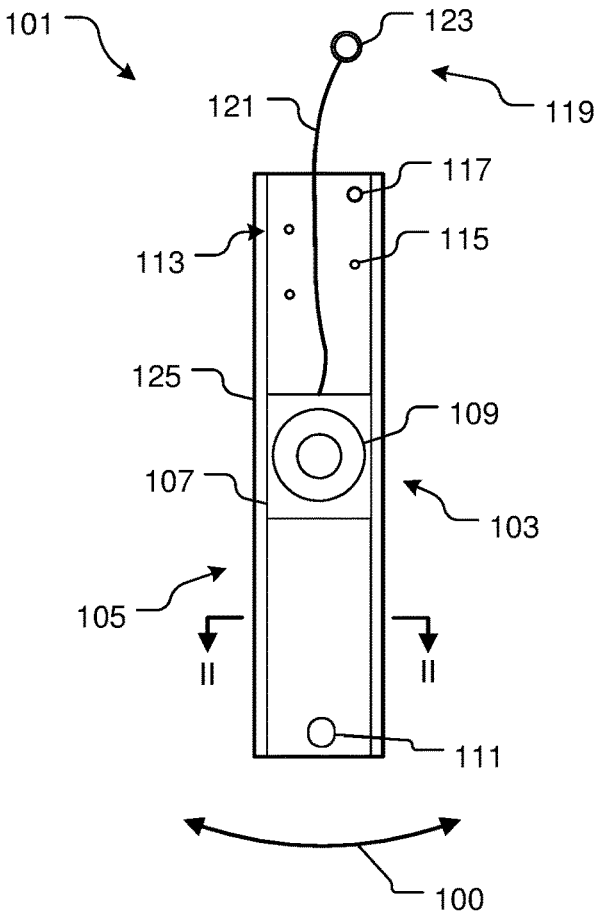
FIG. 1 is a top view of a knober system and method of use in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
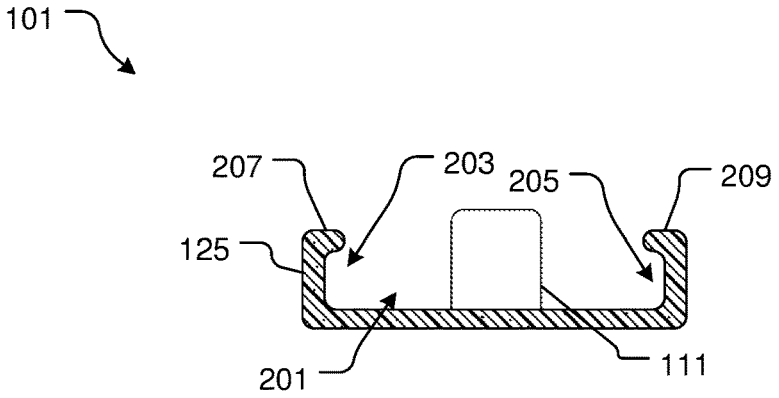
FIG. 2 is a cross-sectional front view of the system of FIG. 1 taken at II-II.
Figure 3:
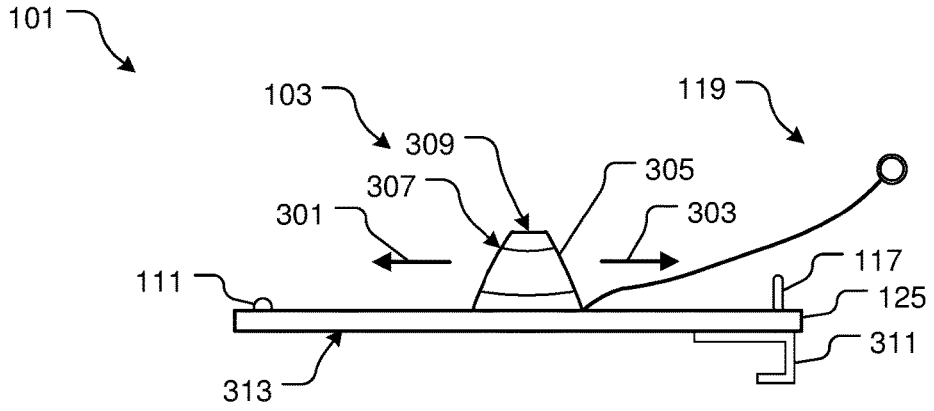
FIG. 3 is a side view of the system of FIG. 1.

Referring now to the drawings wherein like reference characters identify corresponding or similar elements throughout the several views, FIGS. 1-3 depict various views of a knober system 101 and method of use in accordance with a preferred embodiment of the present application. It will be appreciated that system 101 overcomes one or more of the above-listed problems commonly associated with the conventional methods to work out spasms and tight back muscles.

In the contemplated embodiment, system 101 includes one or more of a knober 103 that slidingly engages within a channel 201 created by an elongated structure 105. During use, the knober 103 is adjusted within the channel 201, as depicted with arrows 301 and 303 of FIG. 3. In the preferred embodiment, the knober 103 is adjusted along the elongated length of the support structure 105 in addition to being pivoted about a mount 311, as depicted with an arrow 100 of FIG. 1. Accordingly, the knober 103 is selectively adjusted to reach the tight muscle for applying pressure thereagainst.

The knober 103 comprises of a base 107 that slidingly engages with C-shaped sides 203, 205 formed by a body 125 of elongated support 105. The body 125 includes two arms 207, 209 that partially extend around the base 107 for retaining the base 107 to the channel 201.

The knober 103 further comprises of a protrusion 109 extending from and intergral with base 107. During use, the protrusion comes into contact with the back muscle for applying pressure thereagainst.

An adjuster 119 is secured to the knober 103 and is configured to manually traverse the knober 103 within channel 201. To achieve this feature, the adjuster 119 comprises of a cord or string 121 secured to an optional ring 123. During use, the user may adjust the location of the knober 103 via the adjuster 119 to a selective location along the elongated support 105.

System 101 is further provided with a fixed stop 111 at one end of the elongated support 105 and an optional adjustable stop 113 at an opposing end of the support 105. In one contemplated embodiment, the stop 113 comprises of a plurality of holes 115 configured to receive a removable peg 117, which in turn prevents traverse movement of the knober 103 along the support 105. In one embodiment, the peg 117 could extend through the hole 115. In yet another embodiment, the peg 117 could be secured to the mount 311 that secures to the support structure, e.g., a door frame (not shown). In this embodiment, the elongated support 105 could pivot relative to the peg 117 to create the pivoting movement as depicted with arrow 100.

Referring specifically to FIG. 3, the knober 103 preferably includes a body 305 with a circular contoured surface 307 with a flat top surface 309. This allows the knober 103 to effectively reach and work out the spasms and tight back muscles. As discussed above, the system 101 is provided with a mount 311 configured to engage with a support structure. The mount 311 is preferably secured to a back surface 313 of the elongated body 125.

Figure 4:
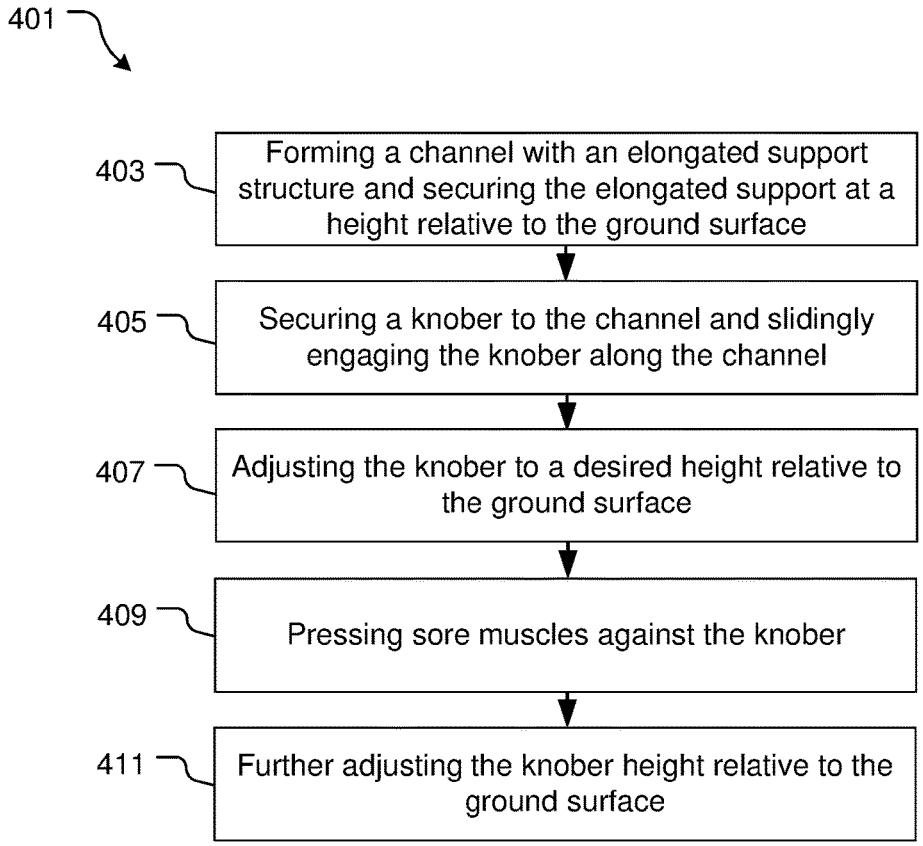
FIG. 4 is a flowchart depicting the preferred process.

In FIG. 4, a flowchart 401 depicts the preferred method of use. The process includes providing the system discussed above and securing the system to a support structure such as a door frame, as depicted with boxes 403, 405. The knober is adjusted to a desired height relative to the ground surface and the tight muscles are pressed thereagainst, as depicted in boxes 407, 409. Finally, the knober is further adjusted with the adjuster to reach different muscle groups.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An adjustable knober system, comprising:

an elongated structure;

a knober adjustably engaged with the elongated structure;

an adjuster secured to the knober and configured to adjust a position of the knober relative to the elongated structure; and a mount secured to a back surface of the elongated structure, the mount is configured to secure the elongated structure to a support structure; and a fixed stop at a first end of the elongated structure; wherein the fixed stop prevents sliding movement of the knober relative to the elongated structure; and an adjustable stop secured to a second end of the elongated structure; wherein the adjustable stop prevents the sliding movement of the knober relative to the elongated structure.

2. The system of claim 1, the elongated structure, comprising:

an elongated body forming a channel with c-shaped sides;

wherein the knober fits within the channel and slidingly engages with the c-shaped sides.

3. The system of claim 1, the knober having:

a base and a protrusion extending from the base.

4. The system of claim 3, wherein the base slidingly engages with the elongated structure.

5. The system of claim 4, the adjuster comprising:

a string secured to the base; and a ring secured to the string.

6. The system of claim 1, the mount being pivotally engaged to the elongated structure.

* * * * *